US011817628B2

(12) United States Patent
Lee et al.

(10) Patent No.: US 11,817,628 B2
(45) Date of Patent: Nov. 14, 2023

(54) DUAL POLARIZED ANTENNA USING SHIFT SERIES FEED

(71) Applicant: KMW INC., Hwaseong-si (KR)

(72) Inventors: Su Won Lee, Yongin-si (KR); Yong Won Seo, Daejeon (KR); Oh Seog Choi, Hwaseong-si (KR); Young Chan Moon, Suwon-si (KR)

(73) Assignee: KMW INC., Hwaseong-si (KR)

( * ) Notice: Subject to any disclaimer, the term of this patent is extended or adjusted under 35 U.S.C. 154(b) by 73 days.

(21) Appl. No.: 17/528,147

(22) Filed: Nov. 16, 2021

(65) Prior Publication Data

US 2022/0077593 A1 Mar. 10, 2022

Related U.S. Application Data

(63) Continuation of application No. PCT/KR2020/005558, filed on Apr. 28, 2020.

(30) Foreign Application Priority Data

May 16, 2019 (KR) ..... 10-2019-0057260
Jul. 16, 2019 (KR) ..... 10-2019-0085446

(51) Int. Cl.

| | |
|---|---|
| ***H01Q 21/06*** | (2006.01) |
| ***H01Q 25/00*** | (2006.01) |
| ***H01Q 21/26*** | (2006.01) |
| ***H01Q 9/04*** | (2006.01) |

(52) U.S. Cl.

CPC ..... *H01Q 21/062* (2013.01); *H01Q 9/0435* (2013.01); *H01Q 9/0457* (2013.01); *H01Q 21/26* (2013.01); *H01Q 25/001* (2013.01)

(58) Field of Classification Search

CPC .... H01Q 21/062; H01Q 21/26; H01Q 25/001; H01Q 9/0457; H01Q 9/0435

See application file for complete search history.

(56) References Cited

U.S. PATENT DOCUMENTS

| | | | | |
|---|---|---|---|---|
| 9,972,918 | B2 * | 5/2018 | Lin | H01Q 9/045 |
| 10,622,706 | B2 * | 4/2020 | Moon | H01Q 5/42 |
| 10,714,837 | B1 * | 7/2020 | Rumsey | H01Q 21/064 |

(Continued)

FOREIGN PATENT DOCUMENTS

| | | | |
|---|---|---|---|
| CN | 109904613 | A * | 6/2019 |
| KR | 10-2013-0134793 | A | 12/2013 |

(Continued)

OTHER PUBLICATIONS

International Search Report dated Aug. 6, 2020 for International Application No. PCT/KR2020/005558 and its English translation.

(Continued)

*Primary Examiner* — Vibol Tan

(74) *Attorney, Agent, or Firm* — INSIGHT LAW GROUP, PLLC; Seung Lee

(57) ABSTRACT

The present disclosure provides a dual-polarized antenna, which is advantageous for a reduction in size by significantly reducing the complexity of a structure while satisfying a Cross Polarization ratio (CPR) characteristic and an isolation characteristic, that is, advantages of a dual feed, by enabling a dual feed using a shift series feed even without another structure in one antenna structure.

10 Claims, 11 Drawing Sheets

(56) References Cited

U.S. PATENT DOCUMENTS

| | | | | |
|---|---|---|---|---|
| 11,177,582 | B2 * | 11/2021 | Seo | H01Q 9/0457 |
| 2004/0217911 | A1 | 11/2004 | Le Bolzer et al. | |
| 2014/0049439 | A1 * | 2/2014 | Ho | H01Q 5/364 343/858 |

FOREIGN PATENT DOCUMENTS

| | | | |
|---|---|---|---|
| KR | 10-2015-0089509 | A | 8/2015 |
| KR | 10-2016-0094897 | A | 8/2016 |
| WO | 2019-124844 | A1 | 6/2019 |

OTHER PUBLICATIONS

Extended European Search Report dated May 17, 2023 from the European Patent Office for European Application No. 20805705.9.

Guanghui Xu et al: "Cavity model analysis 10, 11 of differential dual-polarised annular-ring patch antenna", IET Microwaves, Antennas & Propagation, The Institution of Engineering and Technology, United Kingdom, vol. 13, No. 9, Apr. 29, 2019 (Apr. 29, 2019), pp. 1389-1393, XP006107988.

* cited by examiner (a)

(b)

(a)

(b)

DUAL POLARIZED ANTENNA USING SHIFT SERIES FEED

CROSS-REFERENCE TO RELATED APPLICATION

This application is a continuation of PCT Patent Application PCT/KR2020/005558 filed Apr. 28, 2020 which claims priority from, Korean Patent Application Number 10-2019-0057260 filed on May 16, 2019, and Korean Patent Application Number 10-2019-0085446 filed on Jul. 16, 2019, the disclosures of which is are incorporated by reference herein in its their entirety.

BACKGROUND

The content described in this section merely provides background information for the present disclosure and does not constitute prior art.

A massive multiple input multiple output (MIMO) technology is a technology for significantly increasing a data transmission capacity by using multiple antennas, and is a spatial multiplexing scheme in which a transmitter transmits different data through respective transmission antennas and a receiver classifies transmission data through proper signal processing. Accordingly, the massive MIMO technology enables more data to be transmitted by simultaneously increasing the numbers of transmission and reception antennas and thus increasing a channel capacity. For example, if the number of antennas is increased to ten through the massive MIMO technology, about ten times a channel capacity is secured using the same frequency band compared to a current single antenna system.

As the massive MIMO technology requires multiple antennas, the importance of a reduction in the space occupied by one antenna module, that is, a reduction in the size of an individual antenna, is further highlighted.

In a conventional individual antenna structure, a single feed element has a disadvantage in that isolation and Cross Pol characteristics are not good because the single feed element is implemented as one feed. In order to solve the disadvantage, there was presented a method of implementing the other single feed element in another structure placed on a side opposite to one single feed element by using two structures and implementing a cable or a distributor in the form of a dual feed. However, if such a dual feed method is used, there is a disadvantage in that assembling is not good and are a mass-production problem attributable to a rise in a soldering point, a problem in that a PIMD characteristic is not uniform, etc.

SUMMARY

The present disclosure relates to a dual-polarized antenna using a shift series feed and, more particularly, to a dual-polarized antenna which enables a dual feed using a shift series feed even without another structure in one antenna structure.

The present disclosure provides a dual-polarized antenna, which is advantageous for a reduction in size by significantly reducing the complexity of a structure while satisfying a Cross Polarization ratio (CPR) characteristic and an isolation characteristic, that is, advantages of a dual feed, by enabling a dual feed using a shift series feed even without another structure in one antenna structure.

In one embodiment, a dual-polarized antenna includes a base substrate, a feed unit supported on the base substrate and comprising a first feed substrate and a second feed substrate disposed to cross each other; and a radiation plate supported on the feed unit, wherein the first feed substrate comprises a first feed line configured to supply a first region with a first reference-phase signal in a first direction of the radiation plate and to supply a second region sequential to the first region with a first anti-phase signal having a phase opposite to a phase of the first reference-phase signal according to a shift feed method, and the second feed substrate comprises a second feed line configured to supply a third region with a second reference-phase signal in a second direction of the radiation plate and to supply a fourth region sequential to the third region with a second anti-phase signal having a phase opposite to a phase of the second reference-phase signal according to the shift feed method.

As described above, according to an embodiment of the present disclosure, the dual-polarized antenna can be provided which is advantageous for a reduction in size by significantly reducing the complexity of a structure while satisfying the CPR characteristic and the isolation characteristic, that is, advantages of a dual feed, because the dual feed is implemented without another structure in one antenna structure.

DETAILED DESCRIPTION

Figure 1:
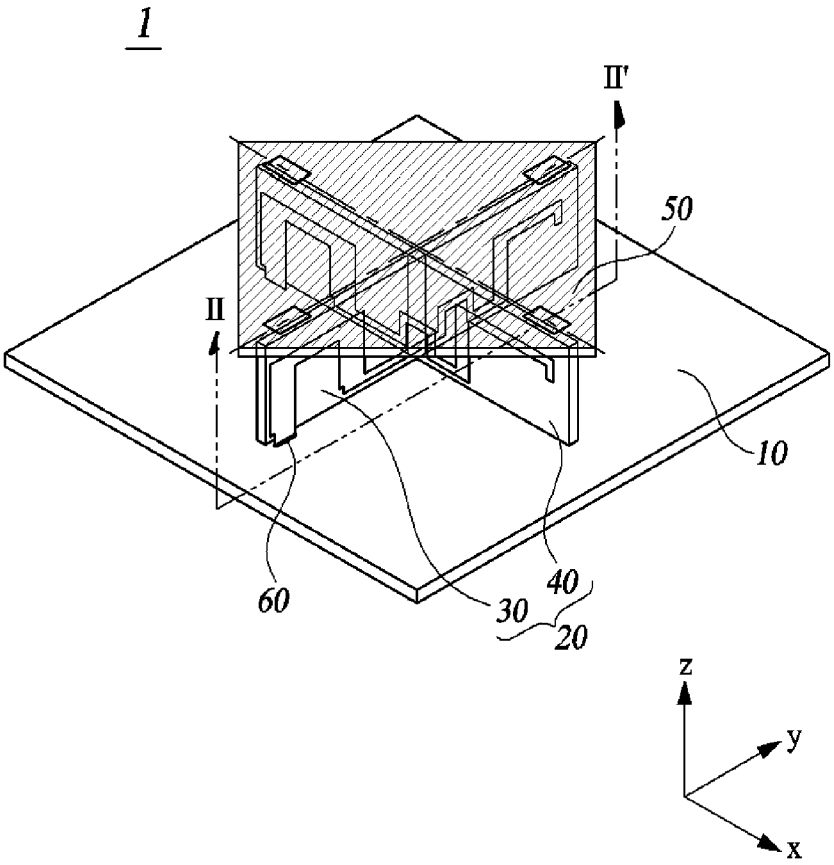
FIG. 1 is a schematic perspective view of a dual-polarized antenna according to an embodiment of the present disclosure.

Hereinafter, some embodiments of the present disclosure are described with reference to the drawings. It should be noted that in giving reference numerals to components of the accompanying drawings, the same or equivalent components are denoted by the same reference numerals even when the components are illustrated in different drawings. In describing the present disclosure, when A detailed description of related known functions or configurations may obscure the subject matter of the present disclosure, the detailed description thereof has been omitted.

FIG. 1 is a schematic perspective view of a dual-polarized antenna 1 according to an embodiment of the present disclosure.

Figure 2:
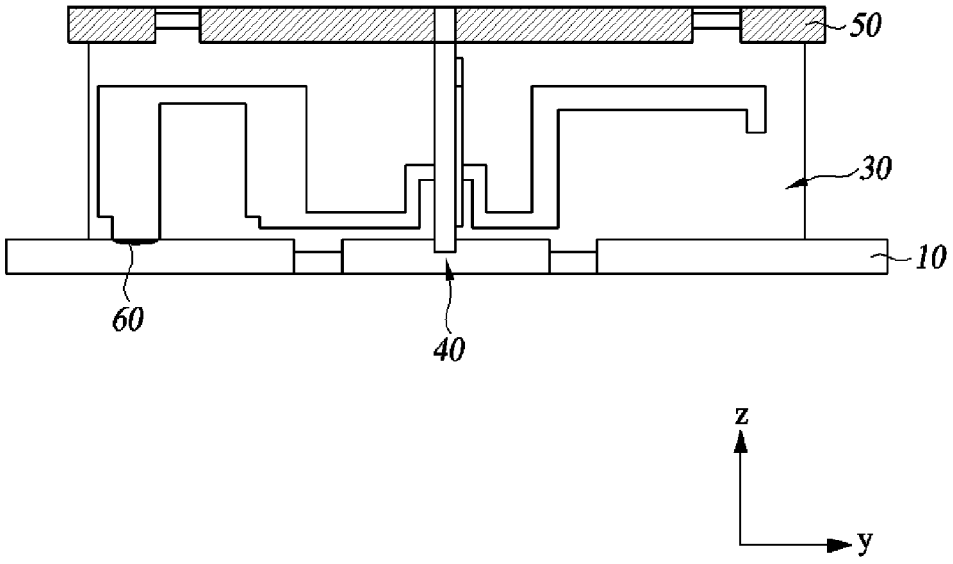
FIG. 2 is a cross-sectional view of the dual-polarized antenna taken along line II-IF in FIG. 1.

FIG. 2 is a cross-sectional view of the dual-polarized antenna 1 taken along line II-IF in FIG. 1.

Figure 3:
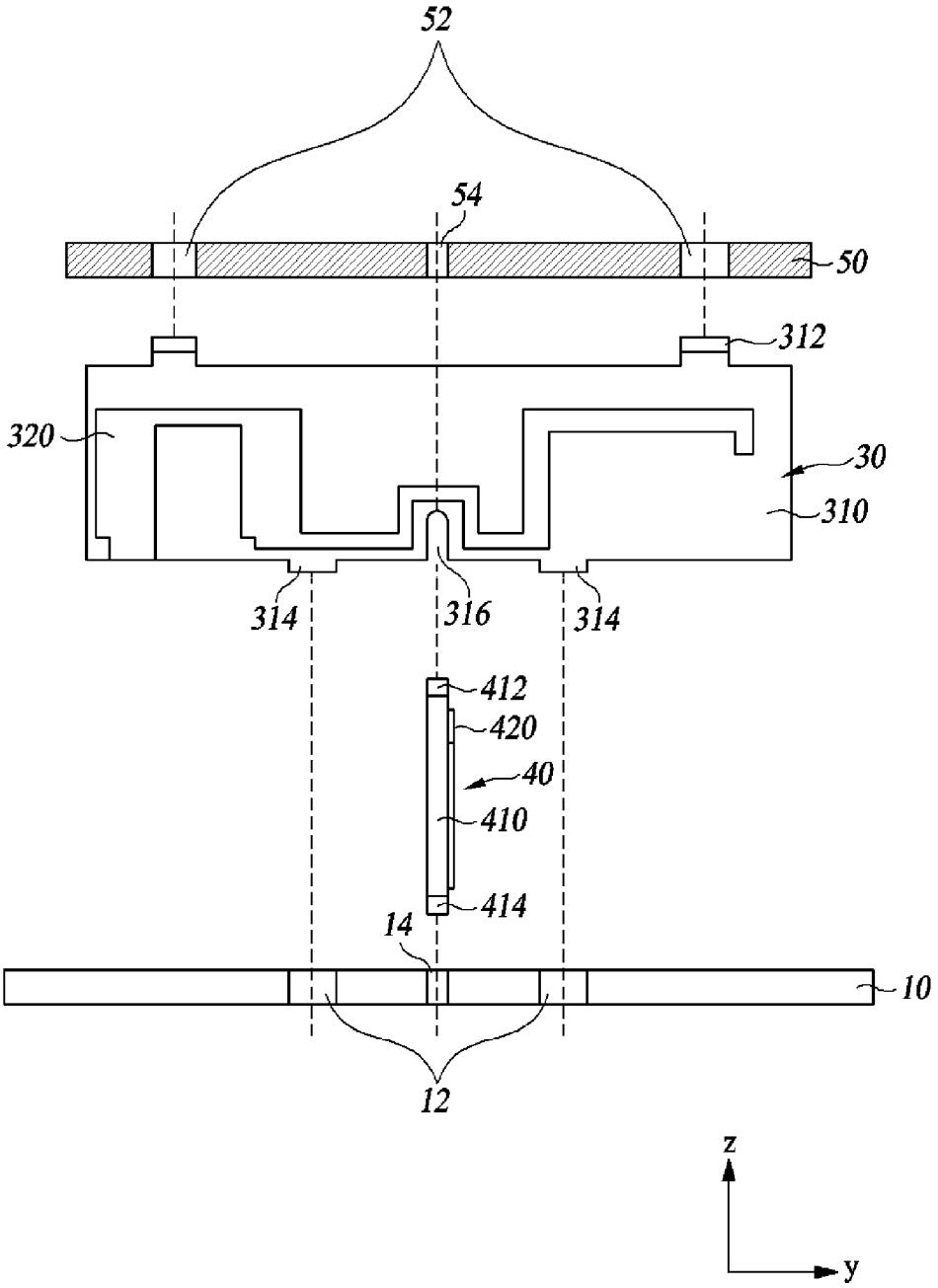
FIG. 3 is an exploded cross-sectional view of the dual-polarized antenna taken along line II-IF in FIG. 1.

FIG. 3 is an exploded cross-sectional view of the dual-polarized antenna 1 taken along line II-IF in FIG. 1.

Figure 4:
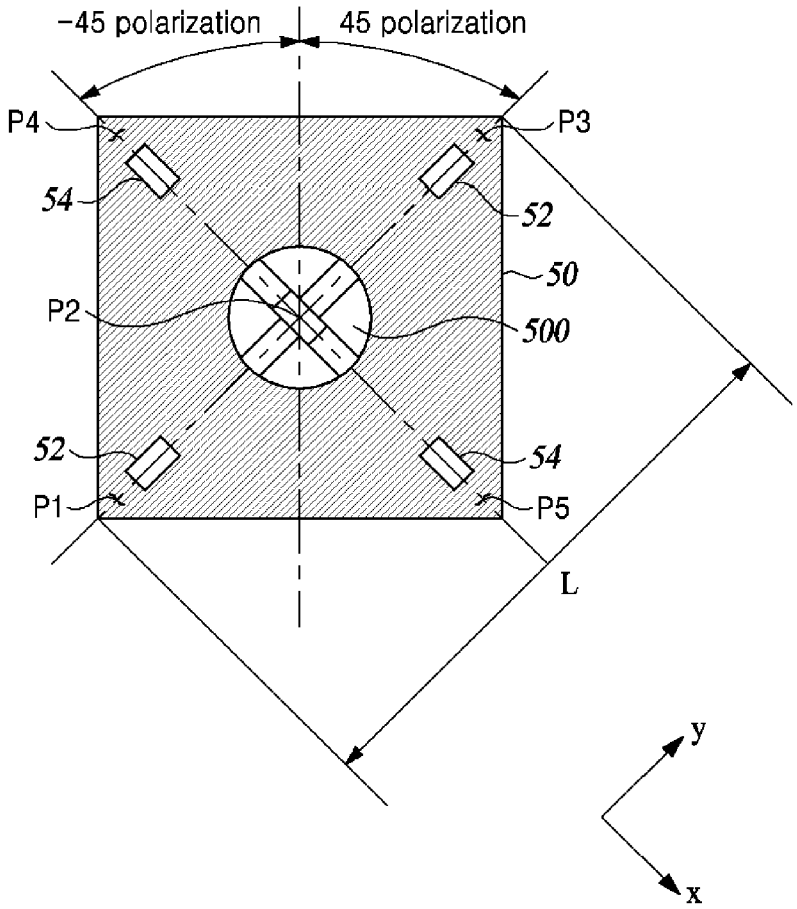
FIG. 4 is a top view of the dual-polarized antenna according to an embodiment of the present disclosure.

FIG. 4 is a top view of the dual-polarized antenna 1 according to an embodiment of the present disclosure.

Referring to FIGS. 1 to 4, the dual-polarized antenna 1 according to an embodiment of the present disclosure includes a base substrate 10, a feed unit 20, and a radiation plate 50.

The base substrate 10 may be a sheet-shaped member made of plastic or metal. The base substrate 10 may include a ground layer. The ground layer of the base substrate 10 provides a ground to the dual-polarized antenna 1 and may apply as a reflection surface for a radio signal radiated from the radiation plate 50. Accordingly, a radio signal radiated from the radiation plate 50 toward the base substrate 10 may be reflected in a main radiation direction. Accordingly, a front versus rear ratio and gain of the dual-polarized antenna 1 according to an embodiment of the present disclosure can be improved.

The feed unit 20 is configured to be supported on the base substrate 10 and to supply a high frequency electrical signal to the radiation plate 50. The feed unit 20 includes a first feed substrate 30 and a second feed substrate 40 disposed to cross each other on the base substrate 10.

In an embodiment of the present disclosure, the first feed substrate 30 and the second feed substrate 40 are perpendicularity disposed on the base substrate 10. The first feed substrate 30 and the second feed substrate 40 may perpendicularly cross each other in respective central regions.

However, the present disclosure is not limited thereto. In a modified embodiment of the present disclosure, the feed unit 20 may include three or more feed substrates. The three or more feed substrates may cross one another in various ways having structural symmetry, and may be supported on the base substrate 10.

The first feed substrate 30 may be a printed circuit board including a first insulating substrate 310 and a first feed line 320 formed on the first insulating substrate 310. The second feed substrate 40 may be a printed circuit board including a second insulating substrate 410 and a second feed line 420 formed on the second insulating substrate 410.

Each of the first feed line 320 and the second feed line 420 may supply a high frequency electrical signal to the radiation plate 50. In the illustrated embodiment, it has been illustrated that the first feed line 320 and the second feed line 420 are isolated from the radiation plate 50 at short distances and are electrically capacitively coupled thereto. However, the present disclosure is not limited thereto. In another embodiment, each of the first feed line 320 and the second feed line 420 may directly electrically come into contact with the radiation plate 50.

Detailed constructions and functions of the first feed line 320 of the first feed substrate 30 and the second feed line 420 of the second feed substrate 40 are described below with reference to FIGS. 5 to 7.

The first feed substrate 30 may include one or more first substrate fastening protrusions 314 formed on a one-side long side thereof. The second feed substrate 40 may include one or more second substrate fastening protrusions 414 formed on a one-side long side thereof.

In accordance with such a structure, the base substrate 10 may include a first substrate-side fastening groove 12 into which each of the first substrate fastening protrusions 314 of the first feed substrate 30 is inserted and a second substrate-side fastening groove 14 into which each of the second substrate fastening protrusions 414 of the second feed substrate 40 is inserted.

In the illustrated embodiment of the present disclosure, it has been illustrated that each of the first substrate fastening protrusions 314 and the second substrate fastening protrusions 414 has been formed by two and accordingly each of the first substrate-side fastening grooves 12 and the second substrate-side fastening grooves 14 has also been formed by two. However, the present disclosure is not limited thereto. In other embodiments of the present disclosure, the number of substrate fastening protrusions 314, 414 and the number of fastening grooves 12, 14 may be selectively changed. Moreover, the first feed substrate 30 and the second feed substrate 40 may be fastened on the base substrate 10 by adhesion or a separate coupling member not an insertion fastening method.

The first feed substrate 30 may include a first coupling slit 316 formed on the one-side long side thereof. The first coupling slit 316 may be a straight-line open part which extends from the center of the one-side long side of the first feed substrate 30 to the inside of the first feed substrate 30.

Likewise, the second feed substrate 40 may include a second coupling slit 416 (illustrated in FIG. 7) formed on the other-side long side thereof. The second coupling slit 416 may be a straight-line open part extending from the center of the other-side long side of the second feed substrate 40 the inside of the second feed substrate 40.

The first feed substrate 30 and the second feed substrate 40 may be disposed or coupled together to cross each other through the first coupling slit 316 and the second coupling slit 416.

In an embodiment of the present disclosure, the first feed substrate 30 and the second feed substrate 40 may have substantially the same structures and electrical characteristics. For example, lengths, widths, and thicknesses of the first feed substrate 30 and the second feed substrate 40 may be mostly the same. However, structural features for enabling the first feed substrate 30 and the second feed substrate 40 to cross each other, for example, directions and structures of the coupling slits 316 and 416 and corresponding some shapes of the feed lines 320 and 420 may be different.

The radiation plate 50 is supported on the feed unit 20, that is, on the first feed substrate 30 and the second feed substrate 40. In an embodiment of the present disclosure, the radiation plate 50 may be a printed circuit board in which a metal layer is formed on one surface. The radiation plate 50 may be disposed to be parallel to the base substrate 10 and to be perpendicular to the first feed substrate 30 and the second feed substrate 40.

In an embodiment of the present disclosure, it has been illustrated that the radiation plate 50 has a rectangle and each of the first feed substrate 30 and the second feed substrate 40 has been disposed to intersect a diagonal direction of the radiation plate 50. However, the present disclosure is not limited thereto. A shape of the radiation plate 50 may be a polygon, a circle or a ring shape.

The radiation plate 50 may include one or more first radiation plate-side fastening grooves 52 and one or more second radiation plate-side fastening grooves 54. In accordance with such a structure, the first feed substrate 30 may include one or more first radiation plate fastening protrusions 312 formed on the other-side long side thereof. The second feed substrate 40 may include one or more second radiation plate fastening protrusions 412 formed on the other-side long side thereof.

The first radiation plate fastening protrusion 312 and the second radiation plate fastening protrusion 412 may be coupled with the first radiation plate-side fastening groove 52 and the second radiation plate-side fastening groove 54, respectively, by being inserted and fit thereto. Accordingly, the radiation plate 50 can be firmly supported on the base substrate 10 through the first feed substrate 30 and the second feed substrate 40 with being isolated from the base substrate 10.

The first feed line 320 of the first feed substrate 30 supplies a first reference-phase signal to a first region (P1→P2) and supplies a first anti-phase signal to a second region (P2→P3) to the radiation plate 50, on the basis of a first direction (P1→P3) of the radiation plate 50.

Likewise, the second feed line 420 of the second feed substrate 40 supplies a second reference-phase signal to a third region (P4→P2) and supplies a second anti-phase signal to a fourth region (P2→P5) on the basis of a second direction (P4→P5) of the radiation plate 50.

In this case, the first reference-phase signal and the first anti-phase signal are high frequency signals having the same characteristic, but having opposite phases. The second reference-phase signal and the second anti-phase signal are also high frequency signals having the same characteristic, but having opposite phases.

In the dual-polarized antenna 1 according to an embodiment of the present disclosure, a straight line that connects the first point P1 and the third point P3 in the radiation plate 50 and a straight line that connects the fourth point P4 and the fifth point P5 in the radiation plate 50 are orthogonal to each other. That is, one polarization (45 polarization) may be radiated in the direction of the straight line that connects the first point P1 and the third point P3. Another polarization (−45 polarization) may be radiated in the direction of the straight line that connects the fourth point P4 and the fifth point P5.

A distance L between the first point P1 and the third point P3 and a distance L between the fourth point P4 and the fifth point P5 depend on a center frequency wavelength (λg) of a use frequency band, but may be different depending on a target characteristic and material. For example, the distance L between the first point P1 and the third point P3 and the distance L between the fourth point P4 and the fifth point P5 may be different depending on a separation between crossing polarizations, a half power beam width, and a dielectric constant of a material of the radiation plate 50.

In an embodiment of the present disclosure, the first point P1 and the third point P3, and the fourth point P4 and the fifth point P5 may neighbor two points farthest from the square radiation plate 50, for example, apexes facing each other in a diagonal direction thereof. That is, in the dual-polarized antenna 1 according to an embodiment of the present disclosure, the first point P1, the third point P3, the fourth point P4, and the fifth point P5 may neighbor four apexes of the square radiation plate 50, respectively. Accordingly, the dual-polarized antenna 1 according to an embodiment of the present disclosure may have a structure having the smallest size while corresponding to a use frequency.

In an embodiment of the present disclosure, the radiation plate 50 may include a circular hole 500 therein (e.g., the center of the radiation plate 50). The circular hole 500 functions to lower a resonant frequency by diverting the direction of a radiated current within the radiation plate 50. For example, in an embodiment of the present disclosure, the circular hole 500 acts as a guide to divert the direction of a radiated current onto the radiation plate 50, so that a resonant frequency can be lowered (e.g., from 4 GHz to 3.5 GHz).

In an embodiment of the present disclosure, the diameter of the circular hole 500 may be differently determined by an area of the radiation plate 50. For example, a low frequency band may be operated with a small device area only when the diameter of the circular hole 500 becomes the dimension of ¼ of a patch area of the radiation plate 50, but the present disclosure is not essentially limited thereto.

Figure 5:
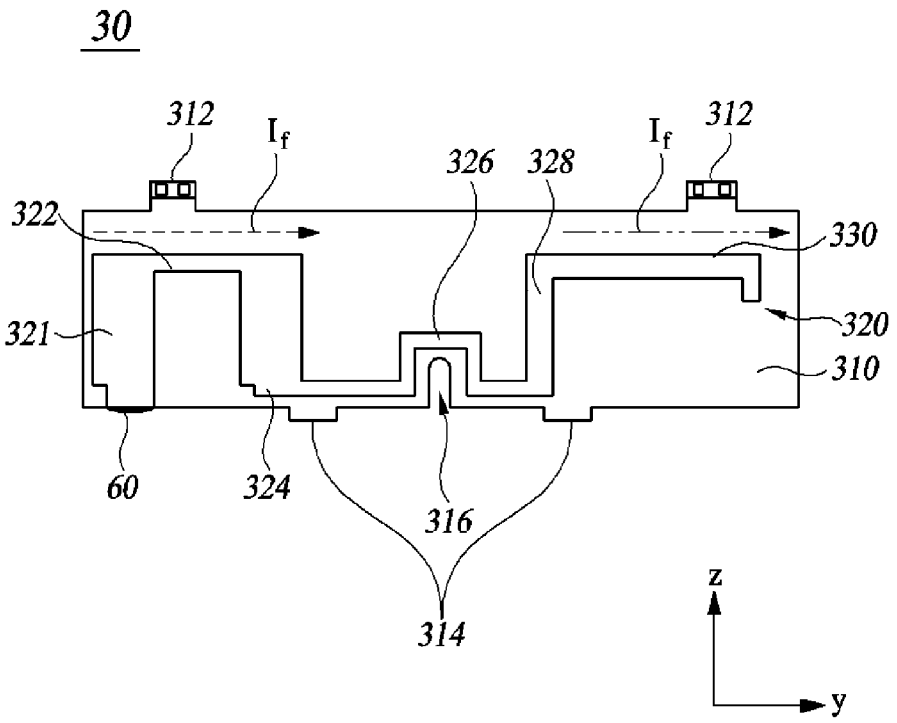
FIG. 5 is one side view of a first feed substrate of the dual-polarized antenna according to an embodiment of the present disclosure.

FIG. 5 is one side view of the first feed substrate 30 of the dual-polarized antenna 1 according to an embodiment of the present disclosure.

Referring to FIG. 5, the first feed substrate 30 according to an embodiment of the present disclosure may include the first insulating substrate 310 and the first feed line 320 formed on the first insulating substrate 310.

In an embodiment of the present disclosure, the first feed line 320 is implemented to have a predetermined time difference on the radiation plate 50, but to enable feeds to be sequentially performed in the same direction (i.e., sequential feeds having a predetermined time difference are performed in the same direction) according to a shift feed method of performing series feeds from a single feed. That is, the first feed line 320 is configured to supply the first reference-phase signal to the first region in a first direction of the radiation plate 50 and to supply the first anti-phase signal having a phase opposite to a phase of the first reference-phase signal to the second region sequential to the first region according to the shift feed method.

The first feed line 320 may include a first direct feed line 321, a first reference-phase coupling electrode 322, a first transfer line 324, a first coupling feed line 328 and a first anti-phase coupling electrode 330.

The first direct feed line 321 may be disposed to neighbor a one-side short side of the first feed substrate 30 on the basis of the first feed substrate 30. The first direct feed line 321 may be a circuit line that extends from the one-side long side of the first feed substrate 30 toward the inside of the first feed substrate 30, for example, the other-side long side of the first feed substrate 30. One end of the first direct feed line 321 may be electrically connected to a signal line of the base substrate 10 on the one-side long side of the first feed substrate 30. In an embodiment of the present disclosure, the first direct feed line 321 may be connected to the signal line of the base substrate 10 through soldering 60. That is, the first feed substrate 30 of the dual-polarized antenna 1 according to an embodiment of the present disclosure may be inserted and coupled with the base substrate 10 by using a surface mounting device and soldered thereto. This may cause a reduction in the product cost and work efficiency.

The other end of the first direct feed line 321 is connected to one end of the first reference-phase coupling electrode 322.

The first reference-phase coupling electrode 322 may be extended from the one-side short side of the first feed substrate 30 toward the other-side short side of the first feed substrate 30. The first reference-phase coupling electrode 322 may be disposed closely to the other-side long side of the first feed substrate 30, not the one-side long side of the first feed substrate 30 that the first direct feed line 321 neighbors. One end of the first reference-phase coupling electrode 322 may be disposed to be adjacent to the one-side short side of the first feed substrate 30. The first reference-phase coupling electrode 322 may be extended in parallel (=a first direction of the radiation plate 50) to the other-side long side of the first feed substrate 30 from a location adjacent to the one-side short side of the first feed substrate 30.

The first transfer line 324 has an anti-phase path length that extends from the other end of the first reference-phase coupling electrode 322 to one end of the first coupling feed line 328.

In an embodiment of the present disclosure, the first transfer line 324 may have a structure shifted by a given path length according to the shift feed method. Accordingly, a high frequency electrical signal transferred to the one end of the first coupling feed line 328 may be reached by being delayed by a difference of an anti-phase path length of the first transfer line 324 compared to the high frequency electrical signal transferred to the one end of the first reference-phase coupling electrode 322. More specifically, the first transfer line 324 may have a shifted structure and path length so that an electric current having a phase difference of 180° compared to a reference-phase signal is applied to the first coupling feed line 328.

Accordingly, the high frequency electrical signal applied to the one end of the first reference-phase coupling electrode 322 and the high frequency electrical signal applied to one end of the first anti-phase coupling electrode 330 may have opposite phases, that is, opposite polarities having the same size.

The first transfer line 324 may include a first bypass line 326 formed to bypass the first coupling slit 316. In an embodiment of the present disclosure, an anti-phase path length of the first transfer line 324 may be set by adding the lengthy of the first bypass line 326.

The first coupling feed line 328 may be a circuit line that extends into the first feed substrate 30, for example, toward the one-side long side of the first feed substrate 30. The first coupling feed line 328 may have one end connected to the other end of the first transfer line 324, and may have the other end connected to one end of the first anti-phase coupling electrode 330.

In the present embodiment, the first coupling feed line 328, together with the first direct feed line 321, may form two L-probe feed structures for supplying the radiation plate 50 with two electrical signals having opposite phases by performing a function as a feed line for supplying the first anti-phase coupling electrode 330 with an anti-phase signal applied through the first transfer line 324.

The first anti-phase coupling electrode 330 may be extended from the other-side short side of the first feed substrate 30 toward the one-side short side thereof. The first anti-phase coupling electrode 330 may be disposed closely to the other-side long side of the first feed substrate 30 not the one-side long side of the first feed substrate 30 to which the first transfer line 324 is adjacent. One end of the first anti-phase coupling electrode 330 may be disposed to be adjacent to the other-side short side of the first feed substrate 30. The first anti-phase coupling electrode 330 may be extended in parallel to the other-side long side of the first feed substrate 30 from a location adjacent to the other-side short side of the first feed substrate 30.

The other end of the first anti-phase coupling electrode 330 may be connected to the other end of the first coupling feed line 328.

When a reference-phase electrical signal is applied to the one end of the first reference-phase coupling electrode 322, the applied reference-phase electrical signal will be fed from the one end of the first reference-phase coupling electrode 322 to the other end thereof, that is, from the one-side short side of the first feed substrate 30 to the other-side short side thereof. A feed current (If) will be supplied in this feed direction.

When an anti-phase electrical signal is applied to the other end of the first anti-phase coupling electrode 330, the applied anti-phase electrical signal will be fed from the one end of the first anti-phase coupling electrode 330 to the other end thereof, that is, toward the other-side short side of the first feed substrate 30 subsequently to a reference-phase electrical signal. A feed current (If) will be supplied in this feed direction.

Referring to FIGS. 1 and 4 together, the first reference-phase coupling electrode 322 and the first anti-phase coupling electrode 330 may be disposed in one diagonal direction that connects the first point P1 and third point P3 of the radiation plate 50, for example, in a 45 polarization orientation.

The one end of the first reference-phase coupling electrode 322 may be disposed to be adjacent to the first point P1 of the radiation plate 50, and may be extended in a direction toward the second point P2 of the radiation plate 50 from a location adjacent to the first point P1 of the radiation plate 50. Furthermore, the one end of the first anti-phase coupling electrode 330 may be disposed to be adjacent to the second point P2 of the radiation plate 50, and may be extended in parallel to the radiation plate 50 in a direction toward the third point P3 of the radiation plate 50 from a location adjacent to the second point P2 of the radiation plate 50.

Accordingly, the first feed line 320 of the first feed substrate 30 may supply a reference-phase signal to the first point P1 of the radiation plate 50, and may supply an anti-phase signal to the second point P2 of the radiation plate 50. Furthermore, the reference-phase signal may be fed from the first point P1 of the radiation plate 50 toward the second point P2 thereof. The anti-phase signal may be sequentially fed from the second point P2 of the radiation plate 50 toward the third point P3 thereof.

Accordingly, according to an embodiment of the present disclosure, in order to radiate one polarization, feeds through at least two points of the radiation plate 50, a so-called dual feed can be performed. Furthermore, the first feed line 320 of the first feed substrate 30 may form two L-probe feed structures for supplying the radiation plate 50 with two electrical signals having opposite phases in one antenna structure.

According to an embodiment of the present disclosure, there are effects in that the complexity of a structure can be significantly reduced while satisfying the CPR characteristic and isolation characteristic, that is, advantages of a dual feed, because the dual feed using a shift series feed is implemented in one antenna structure even without another structure. For example, the existing dipole antenna has a device height of at least 13 mm in the case of an antenna of 3.5 GHz because the existing dipole antenna is implemented to have 214. In contrast, the dual-polarized antenna 1 according to an embodiment of the present disclosure has a height improved by about 40% compared to the existing antenna, and may have the same characteristics, such as a return loss, isolation, and Cross Pol, as the dipole antenna. Moreover, the dual-polarized antenna 1 according to an embodiment of the present disclosure may be implemented without a separate ground.

Figure 6:
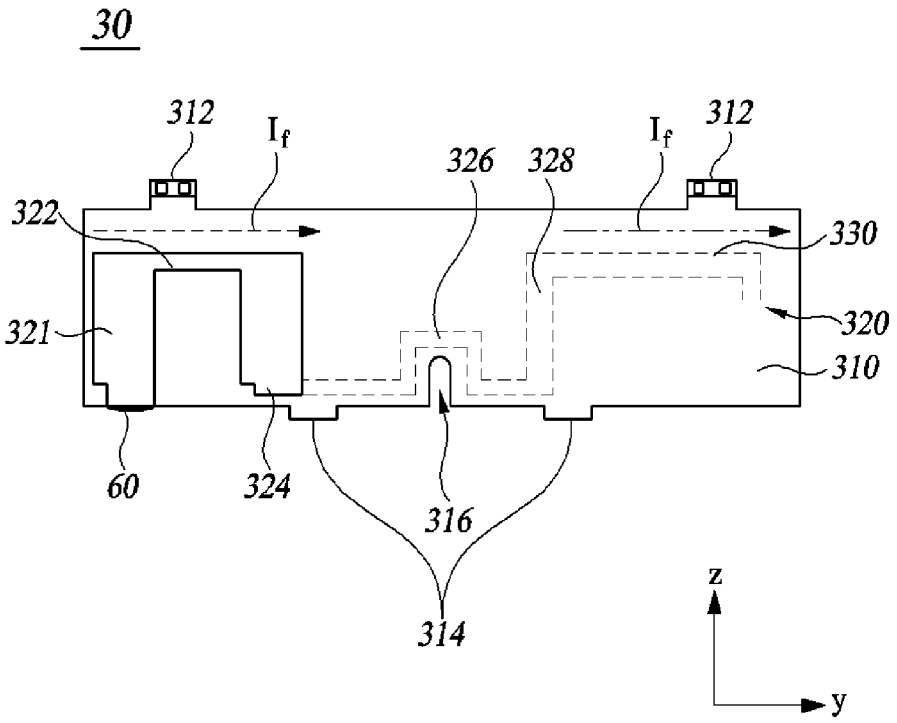
FIG. 6 is one side view of a first feed substrate of the dual-polarized antenna according to another embodiment of the present disclosure.

FIG. 6 is one side view of the first feed substrate 30 of the dual-polarized antenna 1 according to another embodiment of the present disclosure.

Referring to FIG. 6, the first feed substrate 30 according to another embodiment of the present disclosure may have substantially the same components as the (aforementioned) first feed substrate 30 according to the embodiment of the present disclosure, but may be different from that in an arrangement structure of a feed line.

That is, in the first feed substrate 30 according to another embodiment of the present disclosure, a part of the first feed line 320 may be formed in one surface (e.g., the front) of the first feed substrate 30, and the remainder may be formed in the other surface (e.g., the rear) of the first feed substrate 30. In this case, the first feed substrate 30 may be implemented so that an electric current fed through some feed lines formed in the one surface of the first feed substrate 30 are coupled with the remaining feed lines formed in the other surface thereof.

In another embodiment of the present disclosure, a portion corresponding to a reference-phase signal and a portion corresponding to an anti-phase signal within the first feed line 32 of the first feed substrate 30 may be formed on different surfaces, but the present disclosure is not essentially limited thereto.

In the case of the first feed substrate 30 according to another embodiment of the present disclosure, there are advantages in that a frequency band is similar, but electrical characteristics can be easily secured compared to the first feed substrate 30 according to an embodiment of the present disclosure.

Figure 7:
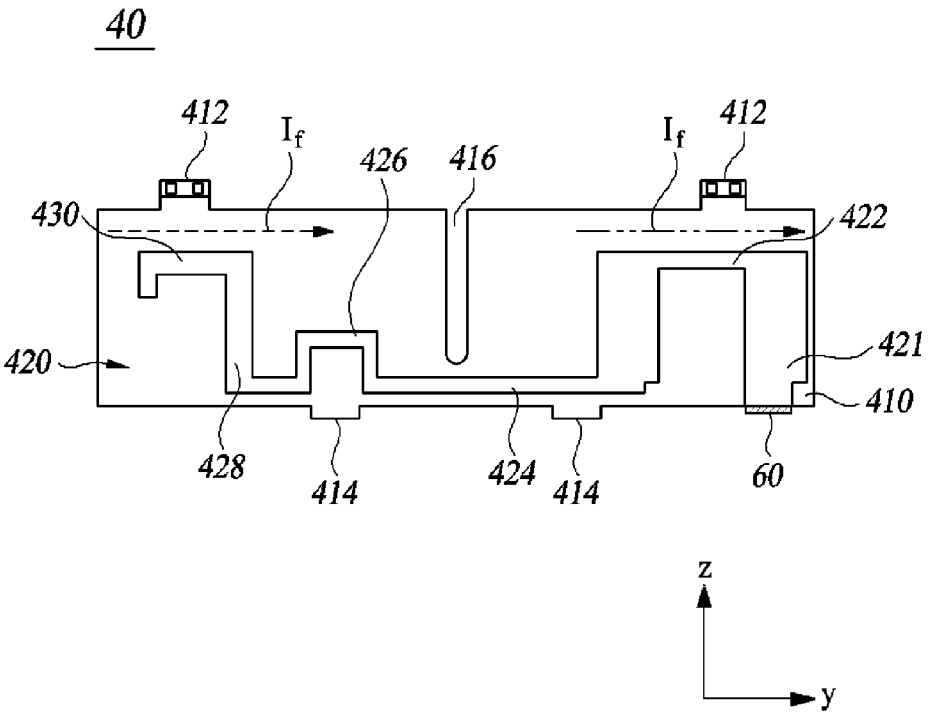
FIG. 7 is one side view of a second feed substrate of the dual-polarized antenna according to an embodiment of the present disclosure.

FIG. 7 is one side view of the second feed substrate 40 of the dual-polarized antenna 1 according to an embodiment of the present disclosure.

Referring to FIG. 7, the second feed substrate 40 according to an embodiment of the present disclosure may include the second insulating substrate 410 and the second feed line 420 formed on the second insulating substrate 410.

The second feed line 420 may include a second direct feed line 421, a second reference-phase coupling electrode 422, a second transfer line 424, a second coupling feed line 428, and a second anti-phase coupling electrode 430.

As described above, in an embodiment of the present disclosure, the first feed substrate 30 and the second feed substrate 40 may have similar structures and functions. Accordingly, shapes and functions of the second direct feed line 421, second reference-phase coupling electrode 422, second transfer line 424, second coupling feed line 428, and second anti-phase coupling electrode 430 of the second feed line 420 of the second feed substrate 40 correspond to those of the first direct feed line 321, first reference-phase coupling electrode 322, first transfer line 324, first coupling feed line 328, and first anti-phase coupling electrode 330 of the first feed line 320 of the first feed substrate 30, respectively.

Hereinafter, in order to avoid a redundant description, components different from those of the first feed substrate 30 among the components of the second feed substrate 40 are chiefly described.

The second transfer line 424 of the second feed substrate 40 may include a second bypass line 426. Unlike the first bypass line 326, the second bypass line 426 is not configured to bypass the second coupling slit 416. However, the second bypass line 426 is added to the second transfer line 424 so that the second transfer line 424 and the first transfer line 324 have the same anti-phase path length.

Accordingly, according to an embodiment of the present disclosure, the first feed line 320 and the second feed line 420 may have shapes as similar as possible, so that the symmetry of the entire dual-polarized antenna 1 structure can be maintained.

Referring to FIGS. 1 and 4 together, the second reference-phase coupling electrode 422 and the second anti-phase coupling electrode 430 may be disposed in one diagonal direction that connects the fourth point P4 and fifth point P5 of the radiation plate 50, for example, in a −45 polarization direction.

One end of the second reference-phase coupling electrode 422 may be disposed to be adjacent to the fourth point P4 of the radiation plate 50. The second reference-phase coupling electrode 422 may be extended in a direction toward the second point P2 of the radiation plate 50 from a location adjacent to the fourth point P4 of the radiation plate 50. Furthermore, one end of the second anti-phase coupling electrode 430 may be disposed to be adjacent to the second point P2 of the radiation plate 50. The second anti-phase coupling electrode 430 may be extended in parallel to the radiation plate 50 in a direction the fifth point P5 of the radiation plate 50 from a location adjacent to the second point P2 of the radiation plate 50.

Accordingly, the second feed line 420 of the second feed substrate 40 may supply a reference-phase signal to the fourth point P4 of the radiation plate 50, and may supply an anti-phase signal to the second point P2 of the radiation plate 50. Furthermore, the reference-phase signal may be fed from the fourth point P4 of the radiation plate 50 to the second point P2 thereof. The anti-phase signals may be sequentially fed from the second point P2 of the radiation plate 50 to the fifth point P5 thereof.

Accordingly, according to an embodiment of the present disclosure, in order to radiate another polarization, feeds through at least two points of the radiation plate 50, a so-called dual feed can be performed. Furthermore, the second feed line 420 of the second feed substrate 40 may form two L-probe feed structures for supplying the radiation plate 50 with two electrical signals having opposite phases in one antenna structure.

Likewise, as in the first feed substrate 30 according to an embodiment of the present disclosure, in the second feed substrate 40, a part of the second feed line 420 may be formed in one surface (e.g., the front) of the second feed substrate 40. The remainder of the second feed line 420 may be formed in the other surface (e.g., the rear) of the second feed substrate 40.

Accordingly, the first feed line 320 and the second feed line 420 according to an embodiment of the present disclosure may be implemented so that all the feed lines thereof are formed in one surface of the feed substrate or some of the feed lines of any one thereof are formed in one surface of the feed substrate and the remainder thereof is formed in the other surface of the feed substrate. The feeding lines of the first feed line 320 and the second feed line 420 may be implemented as a proper combination based on a frequency characteristic that will satisfy the dual-polarized antenna 1 of the present disclosure.

Figure 8:
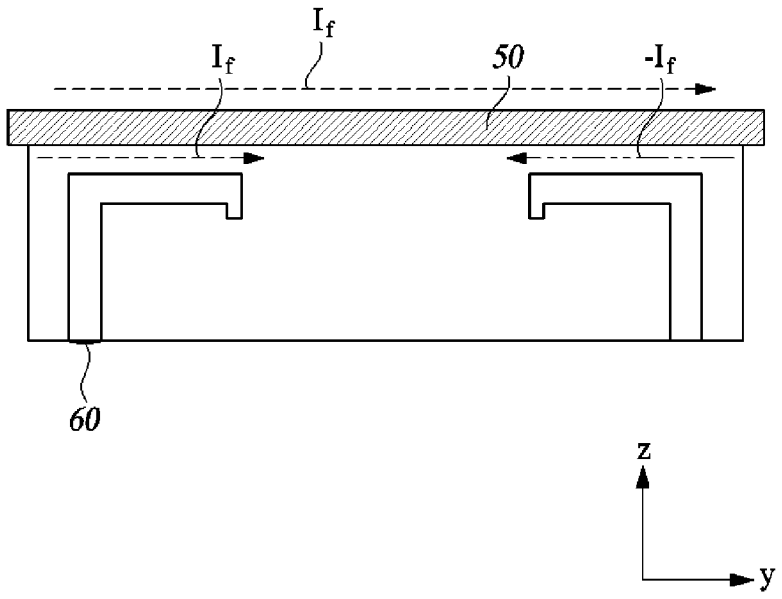
FIG. 8 is a schematic view of a comparison example illustrating a conventional dual feed method.

FIG. 8 is a schematic view of a comparison example illustrating a conventional dual feed method.

Figure 9:
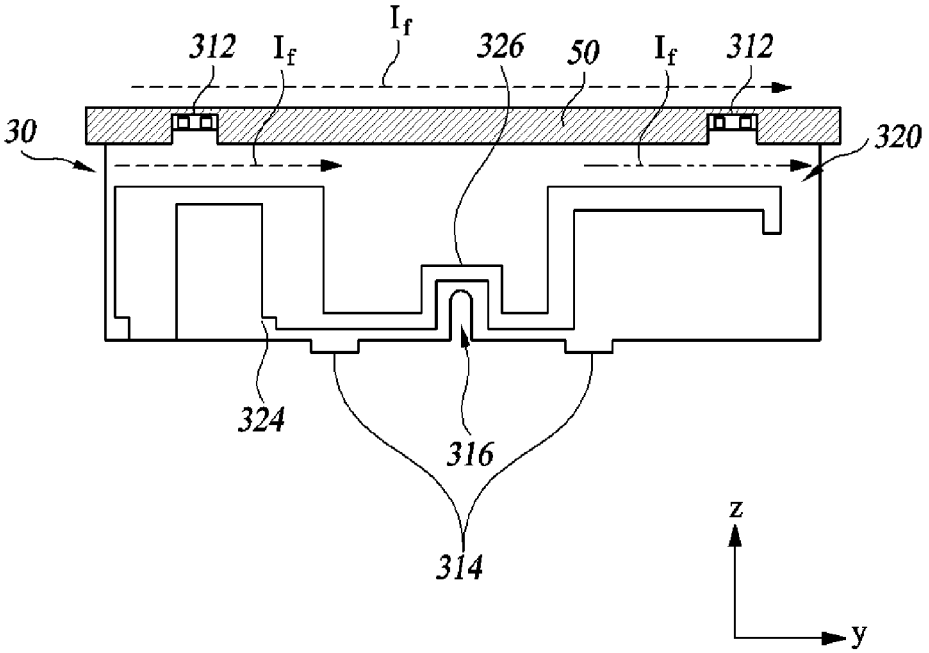
FIG. 9 is a schematic view illustrating a dual feed method according to an embodiment of the present disclosure.

FIG. 9 is a schematic view illustrating a dual feed method according to an embodiment of the present disclosure.

Figure 10:
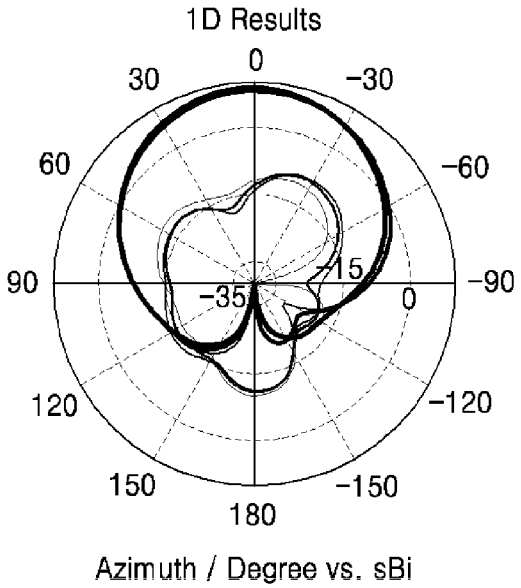
FIG. 10 is a simulation graph of a radiation pattern appearing in a structure according to a comparison example.
Figure 10:
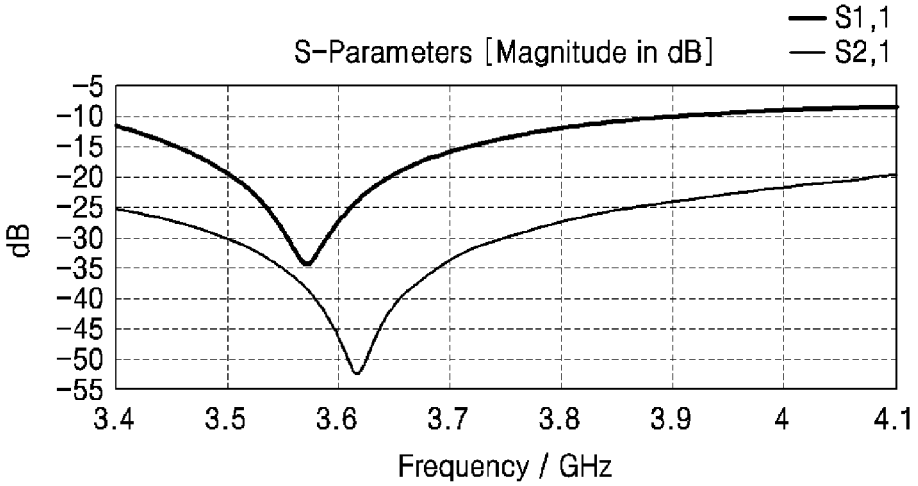

FIG. 10 is a simulation graph of a radiation pattern appearing in a structure according to a comparison example.

Figure 11:
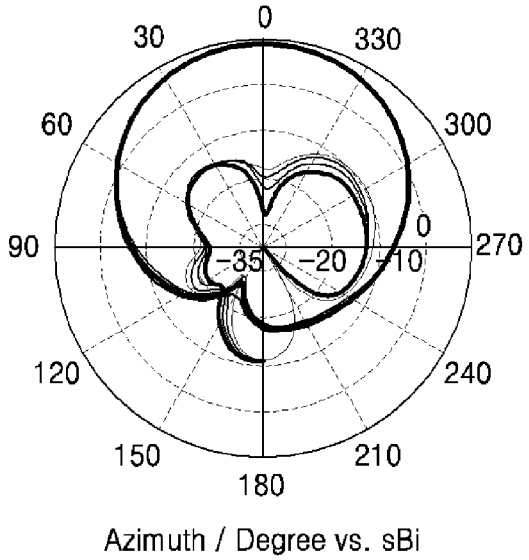
FIG. 11 is a simulation graph of a radiation pattern appearing in the dual feed method according to an embodiment of the present disclosure.
Figure 11:
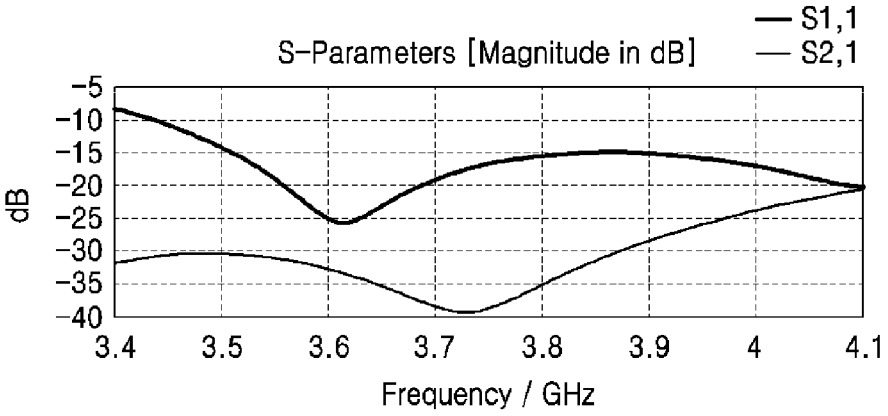

FIG. 11 is a simulation graph of a radiation pattern appearing in the dual feed method according to an embodiment of the present disclosure.

In a conventional individual antenna structure, a single feed element has a disadvantage in that isolation and Cross Pol characteristics are not good because the single feed element is implemented as one feed. In order to solve the disadvantage, as illustrated in FIG. 8, there was presented a method of implementing the other single feed element in another structure placed on a side opposite to one single feed element by using two structures and implementing a cable or a distributor in the form of a dual feed. However, if such a dual feed method is used, there is a disadvantage in that assembling is not good and a structure is complicated due to a mass-production problem attributable to a rise in a soldering point, a problem in that a PIMD characteristic is not uniform, etc.

In order to solve such problems, the dual feed method illustrated in FIG. 9 according to an embodiment of the present disclosure is implemented to enable a dual feed using a shift series feed even without another structure in one antenna structure. For example, if the dual feed method according to an embodiment of the present disclosure is used, sequential feeds having a predetermined time difference may be performed in the same direction on the radiation plate 50 according to the shift feed method of performing series feeds from a single feed. This has effects in that the cross polarization ratio (CPR) characteristic and the isolation characteristic, that is, advantages of a dual feed, are satisfied and the size of a dual-polarized antenna can be reduced because the complexity of a structure is significantly reduced.

From a comparison between FIGS. 10 and 11, it may be seen that a radiation pattern, a bandwidth, and the isolation Cross Pol characteristic become better compared to the conventional dual feed method if the dual feed method according to an embodiment of the present disclosure is used.

Although embodiments of the present disclosure have been described for illustrative purposes, those having ordinary skill in the art should appreciate that various modifications, additions, and substitutions are possible, without departing from the idea and scope of the present disclosure. Therefore, embodiments of the present disclosure have been described for the sake of brevity and clarity. The scope of the technical idea of the present embodiments is not limited by the illustrations. Accordingly, those having ordinary skill should understand the scope of the present disclosure should not be limited by the above explicitly described embodiments but by the claims and equivalents thereof.

What is claimed is:

1. A dual-polarized antenna comprising:

a base substrate;

a feed unit supported on the base substrate and comprising a first feed substrate and a second feed substrate disposed to cross each other; and a radiation plate supported on the feed unit, wherein the first feed substrate comprises a first feed line configured to supply a first region with a first reference-phase signal in a first direction of the radiation plate and to supply a second region sequential to the first region with a first anti-phase signal having a phase opposite to a phase of the first reference-phase signal according to a shift feed method, and the second feed substrate comprises a second feed line configured to supply a third region with a second reference-phase signal in a second direction of the radiation plate and to supply a fourth region sequential to the third region with a second anti-phase signal having a phase opposite to a phase of the second reference-phase signal according to the shift feed method, wherein each of the first feed line and the second feed line is implemented so that sequential feeds having a predetermined time difference are performed in an identical direction on the radiation plate according to the shift feed method.

2. The dual-polarized antenna of claim 1, wherein:

the first feed line comprises a first reference-phase coupling electrode extending in parallel to the first region and a first anti-phase coupling electrode extending in parallel to the second region in the first direction from one-side short side of the first feed substrate, and the second feed line comprises a second reference-phase coupling electrode extending in parallel to the third region and a second anti-phase coupling electrode extending in parallel to the fourth region in the second direction from one-side short side of the second feed substrate.

3. The dual-polarized antenna of claim 2, wherein:

the first feed line further comprises a first direct feed line having one end electrically connected to a signal line of the base substrate on one-side long side of the first feed line and having another end connected to one end of the first reference-phase coupling electrode, a first coupling feed line extending from one end of the first anti-phase coupling electrode toward a one-side long side of the first feed substrate, and a first transfer line connected from another end of the first reference-phase coupling electrode to one end of the first coupling feed line, and the second feed line comprises a second direct feed line having one end electrically connected to the signal line of the base substrate on one-side long side of the second feed line and having another end connected to one end of the second reference-phase coupling electrode, a second coupling feed line extending from one end of the second anti-phase coupling electrode to a one-side long side of the second feed substrate, and a second transfer line connected from another end of the second reference-phase coupling electrode to one end of the second coupling feed line.

4. The dual-polarized antenna of claim 3, wherein each of the first transfer line and the second transfer line has a shifted structure and path length so that an electric current having a phase difference of 180° compared to a reference-phase signal is applied to each coupling feed line.

5. The dual-polarized antenna of claim 4, wherein the first coupling feed line and the second coupling feed line form an L-probe feed structure by performing a function as a feed line for supplying a corresponding anti-phase coupling electrode with an anti-phase signal applied through a corresponding transfer line.

6. The dual-polarized antenna of claim 1, wherein:

a part of at least one of the first feed line and the second feed line is formed in one surface of the feed substrate, and a remainder of the at least one of the first feed line and the second feed line is formed in another surface of the feed substrate.

7. The dual-polarized antenna of claim 6, wherein in at least one of the first feed line and the second feed line, a portion corresponding to a reference-phase signal is formed in the one surface, and a portion corresponding to an anti-phase signal is formed in the another surface.

8. The dual-polarized antenna of claim 6, wherein at least one of the first feed line and the second feed line is implemented so that an electric current fed through some feed lines formed in the one surface is coupled with remaining feed lines formed in the another surface.

9. The dual-polarized antenna of claim 1, wherein:

the radiation plate is square, and a circular hole for diverting a direction of a radiated current within the radiation plate is formed in the radiation plate.

10. The dual-polarized antenna of claim 9, wherein:

a length of a diagonal line of the radiation plate is identical with a length of a half wavelength of a center frequency of a use frequency, and a diameter of the hole is determined based on an area of the radiation plate.

* * * * *